US011920303B2

(12) United States Patent
Klaschka et al.

(10) Patent No.: US 11,920,303 B2
(45) Date of Patent: Mar. 5, 2024

(54) FABRIC AND USE OF THE FABRIC IN A TISSUE MACHINE

(71) Applicant: Voith Patent GmbH, Heidenheim (DE)

(72) Inventors: Susanne Klaschka, Cologne (DE); Robert Eberhardt, Ellwangen (DE); Hubert Walkenhaus, Kerpen (DE)

(73) Assignee: Voith Patent GmbH, Heidenheim (DE)

( * ) Notice: Subject to any disclaimer, the term of this patent is extended or adjusted under 35 U.S.C. 154(b) by 164 days.

(21) Appl. No.: 17/608,607

(22) PCT Filed: Mar. 12, 2020

(86) PCT No.: PCT/EP2020/056701
§ 371 (c)(1),
(2) Date: Nov. 3, 2021

(87) PCT Pub. No.: WO2020/224834
PCT Pub. Date: Nov. 12, 2020

(65) Prior Publication Data

US 2022/0228317 A1 Jul. 21, 2022

(30) Foreign Application Priority Data

May 3, 2019 (DE) ..... 102019111441.1

(51) Int. Cl.
*D21F 7/08* (2006.01)
*D21F 3/02* (2006.01)
(Continued)

(52) U.S. Cl.
CPC ..... *D21F 7/083* (2013.01); *D21F 3/0272* (2013.01); *D21F 3/045* (2013.01); *D21F 11/14* (2013.01)

(58) Field of Classification Search
CPC .... D21F 1/0027; D21F 1/0036; D21F 1/0045; D21F 1/0054; D21F 3/0227;
(Continued)

(56) References Cited

U.S. PATENT DOCUMENTS 5,429,686 A * 7/1995 Chiu ..... D21F 11/006 442/195
5,618,612 A * 4/1997 Gstrein ..... D21F 7/083 442/247
(Continued)

FOREIGN PATENT DOCUMENTS

DE 60105700 T2 2/2005
DE 102011004565 A1 8/2012
(Continued)

*Primary Examiner* — Eric Hug
(74) *Attorney, Agent, or Firm* — Laurence A. Greenberg; Werner H. Stemer; Ralph E. Locher

(57) ABSTRACT

A fabric, in particular a felt, for use in a machine for producing a tissue web, has a base structure, which has a textile structure with MD threads, and at least one layer of nonwoven fibers. The MD threads predominantly or as a whole have a diameter ranging between 0.25 mm and 0.45 mm, in particular between 0.3 mm and 0.35 mm, and the thread density of the MD threads is more than 37%, in particular between 37% and 45%. There is also described a machine and a method for producing a tissue web using such a fabric.

20 Claims, 1 Drawing Sheet

(51) Int. Cl.
*D21F 3/04* (2006.01)
*D21F 11/14* (2006.01)

(58) Field of Classification Search
CPC ..... D21F 3/0236; D21F 3/0281; D21F 3/045; D21F 7/08; D21F 7/083; D21F 7/10; D21F 7/12; D21F 11/006; D21F 11/14
USPC ..... 162/348, 358.2, 900, 902–904, 116
See application file for complete search history.

(56) References Cited

U.S. PATENT DOCUMENTS

| | | | | |
|---|---|---|---|---|
| 6,514,386 | B2 | 2/2003 | Watanabe | |
| 2004/0094281 | A1 | 5/2004 | Hansen | |
| 2007/0240842 | A1* | 10/2007 | Scherb | D21F 11/145 162/358.3 |
| 2014/0186579 | A1* | 7/2014 | Botelho | B29C 66/8322 428/193 |
| 2015/0315728 | A1* | 11/2015 | Yang | D04B 9/06 66/13 |
| 2018/0135247 | A1 | 5/2018 | Lee | |

FOREIGN PATENT DOCUMENTS

| | | | |
|---|---|---|---|
| EP | 0425523 | B1 | 3/1995 |
| EP | 1184511 | A2 | 3/2002 |
| EP | 1270807 | A1 | 1/2003 |
| EP | 1167115 | B1 | 9/2005 |
| EP | 2602387 | B1 | 7/2016 |
| WO | 2014172594 | A1 | 10/2014 |

* cited by examiner

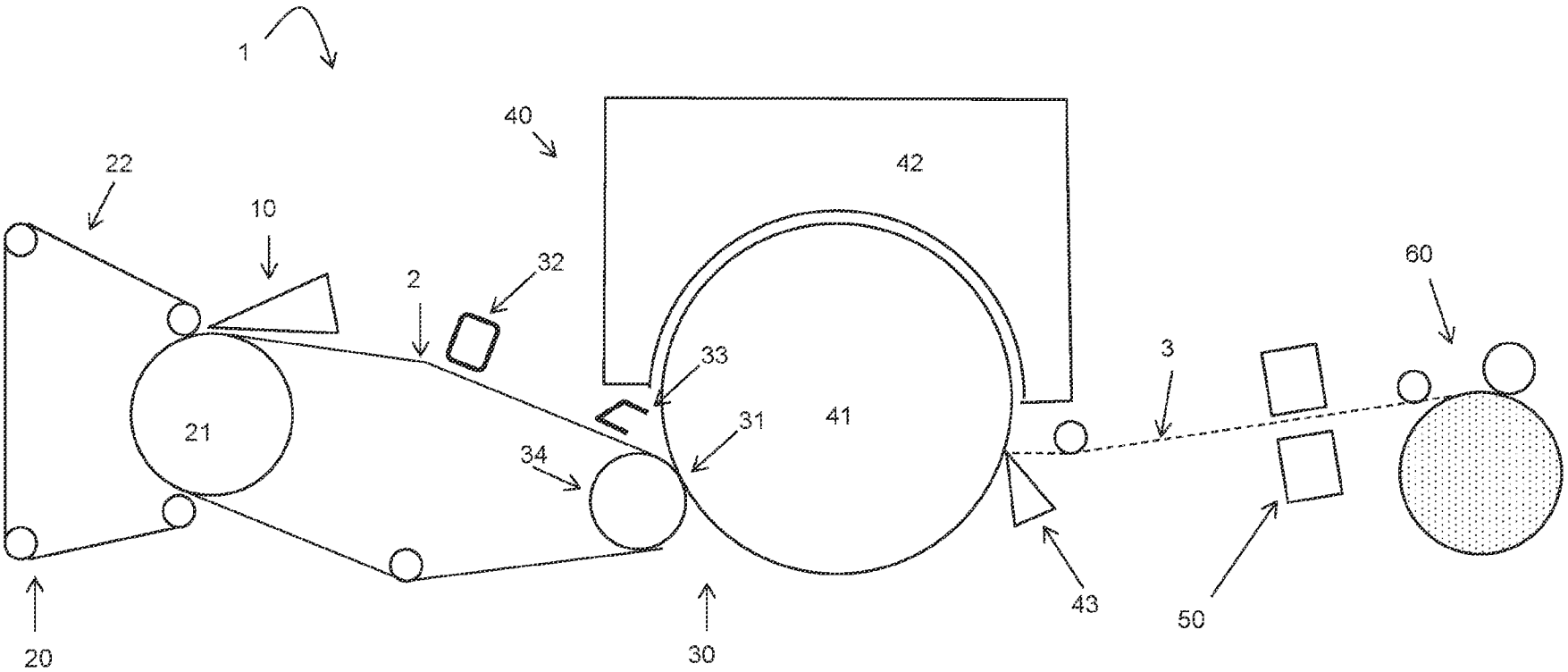
1
10
22
21
20
2
32
40
42
41
33
31
34
30
3
43
50
60

FABRIC AND USE OF THE FABRIC IN A TISSUE MACHINE

FIELD AND BACKGROUND OF THE INVENTION

The invention relates to a fabric for a machine for producing a tissue web and a machine and a method for producing a tissue web with such a fabric. The fabric, in particular a felt, has a base structure, which consists of a woven textile structure having MD threads and CD threads, and at least one layer of nonwoven fibers.

The production of tissue or hygienic papers is still a rapidly growing market. A machine such as is typically used in tissue production is described in EP 3 167 115 B1. As is generally the case in paper production, here, too, a fibrous material suspension is applied to a fabric or between two fabrics and dewatered by evacuation. After that, the fibrous web is further dewatered in a press and then further dried thermally. The fibrous web is transported into the press on a water-absorbing fabric. The water pressed out of the web is absorbed by the fabric and, after the fibrous web has been removed, is removed from the fabric again. This is carried out by means of suction boxes, so-called Uhle boxes, as described by way of example in EP 2 602 387 B1.

Modern tissue machines are operated with very high production speeds, as a result of which the residence times of the tissue web in the press nip are very short. Insufficient dewatering of the web in the press is therefore generally the limiting factor which prevents an increase in the production speed of the machine.

SUMMARY OF THE INVENTION

It is therefore an object of the invention to propose a machine and a method for its operation which ensures improved dewatering of the tissue web.

It is a further object of the invention to propose a conversion solution for existing installations which can be implemented with little or no outlay.

It is a further object of the invention to propose a fabric which enables a significantly improved dewatering of the tissue web.

The objects are achieved completely by a fabric as claimed, a machine as claimed and a method as claimed. Further advantageous features of the embodiment according to the invention will be found in the dependent claims.

With regard to the fabric, the object is achieved by a fabric, in particular a felt, for use in a machine for producing a tissue web. The fabric comprises a base structure, which has or consists of a woven textile structure with MD threads and CD threads. Furthermore, the fabric comprises at least one layer of nonwoven fibers. According to the invention, provision is made for the MD threads wholly or predominantly to have a diameter between 0.25 mm and 0.45 mm, in particular between 0.3 mm and 0.35 mm, and for the thread density of the MD threads to be more than 37%, in particular between 37% and 45%.

The term "wholly or predominantly" is to be understood such that at least 90% of the MD threads, preferably 95%, in particular all the MD threads, have a diameter in the specified range.

Within the context of this application, the term "diameter of a thread" is used. In the case of round threads, this term is well-defined.

For monofilaments which deviate from the round shape, or else for threads twisted from multiple monofilaments, the diameter of the thread is to be understood to be the diameter of the smallest circle which encloses the cross section of the thread.

To determine the thread density of the MD threads, the number of threads per unit length is multiplied by their diameter and the value set in relation to the unit length.

Thus, with 10 threads/cm and a thread diameter of 0.40 mm, the result is a thread density of 10*0.4 mm/10 mm=40%.

By means of the combination of fine MD threads and a high MD thread density, the base structure can perform part of the functionality which is otherwise performed in the fabric by one or more nonwoven layers, such as, for example, evening out the pressure. The base structure permits a uniform pressure distribution through the felt, which was previously thus not possible. Experiments by the applicant have surprisingly shown that fabrics, in particular felts with such base structures, can manage with a lesser nonwoven overlay. This is not only economically advantageous as a result of the saved nonwoven layers, but permits improved dewatering even when used in a tissue machine. With a thinner felt, for example in the press of a tissue machine, nip dewatering can also further be achieved in addition to the Uhle box dewatering.

In preferred embodiments base structure is composed of two endless woven layers or two woven layers which have been made endless, wherein in both woven layers the MD threads wholly or predominantly have a diameter between 0.25 mm and 0.45 mm, in particular between 0.3 mm and 0.35 mm, and the thread density of the MD threads is more than 37%, in particular between 37% and 45%. This may be a two-layer woven material or two separate layers of woven material.

In preferred embodiments it may be provided for the textile structure to be composed of flatweave, wherein the warp threads of the loom are the MD threads of the fabric. The flatweave can, for example, have a plain weave.

Advantageously, the textile structure can comprise a woven material, a leno weave, a scrim or a knitted material or comprise such a material.

In the event that a woven material is used as the base structure, it should be pointed out that tubular woven materials are usually used for base structures of fabrics. These tubular woven materials are rotated by 90° for installation in the machine. As a result, the weft threads of the loom become the MD threads of the fabric, and the warp threads become the CD threads.

One alternative to this is the use of a flatweave.

In EP 0 425 523 B1, Paul Sudre describes the principle of producing a seamed fabric by means of a flatweave.

It is, however, also possible to use a flatweave which has the length of the fabric to be produced, and to connect the two front ends to one another. This also gives rise to an endless woven material structure which can be used as base structure or as part thereof.

Since, as a rule, the length of fabrics is considerably greater in the machine direction than their width in the CD direction, and the width of the loom is sufficiently large for the width of the machine, the necessary flatweave can most simply be implemented by weaving a sufficiently long piece, wherein the warp threads then become the MD threads in the fabric. A rotation by 90°, as in a tubular woven material, is not necessary. According to one aspect of the present invention, this is very advantageous for a fabric. While in a loom the warp threads can in principle be arranged as close beside one another as desired, two adjacent weft threads are necessarily spaced apart from each other as a result of the fact that the warp threads, for example in a plain weave, each change from top to bottom or vice versa between each weft thread pair. As a result of this forced spacing of the weft threads, together with the 90° rotation, such an MD thread density is impossible or possible only with very great difficulty when using very thin threads with conventional tubular woven materials. In the case of flatweaves, on the other hand, the warp threads serving as MD threads can be arranged as close to one another as desired, as a result of which fabrics having the properties described in the invention are comparatively simple to produce.

When flatweaves are used in the base structure, in advantageous embodiments the flatweave can be made endless by connecting the front ends. This connection can be made in particular by a welded connection. Here, ultrasonic welding and laser welding, in particular laser transmission welding, have proven to be suitable welding methods. If necessary, it may be advantageous to connect the two front ends with the aid of a connecting element. This can be, for example, one or more thread/threads, which is/are arranged in the CD direction and connected, in particular welded, to the MD threads of the two ends.

In advantageous embodiments, it may be provided for the base structure to be composed of two flatweaves which have been made endless. The two woven material loops can then be combined to form a two-layer structure. The two woven material loops can then be connected to one another for example by needling with one or more nonwoven layers. Alternatively or additionally, still further forms of connection may also be provided, such as for example sewing or welding the two layers.

The base structure can consist of a textile structure or comprise still further elements. In particular, the base structure can have still further textile structures, such as, for example, further woven materials.

Various materials can be used for the MD threads. Polyamides such as, for example, PA 6, PA 6.6 are suitable but also other polymers such as, for example, PET. If there are CD threads present, these can be built up from the same or another polymer.

Provision can be made for all the MD threads to be of the same type. However, different types of MD threads can also be used. As a result, for example, the fiber anchoring or the dimensional stability can be influenced. Advantageously, MD threads are monofilaments.

There are also various possibilities in the selection of the CD threads. In addition to monofilaments, multi-filaments or twisted threads can also be used.

Suitable twisted threads can consist of 4 or 6 filaments. The filaments used can have a diameter of 0.15-0.25 mm. For example, 0.2×2×2 twisted threads are very suitable.

In advantageous embodiments, all the CD threads can be designed as twisted threads. Here, both all the CD threads can consist of the same twisted thread. Alternatively, various twisted threads can also be used.

It may also be advantageous if both twisted threads and monofilaments are used as CD threads. In this case, preferably around 50% of the CD threads or more are designed as twisted thread.

A preferred embodiment, twisted threads and monofilaments can be provided alternately as CD threads. In this case, the proportion of twisted threads in the CD threads is 50% or less if, for technical reasons, for example to form seam loops, individual CD threads have to be removed.

In advantageous embodiments, the fabric can have one or more nonwoven layers. The layer or layers can be arranged on the paper side and/or the running side of the fabric.

Preferably, the weight of the fabric is between 750 g/m$^2$ and 1250 g/m$^2$, in particular between 900 g/m$^2$ and 1100 g/m$^2$. In special cases, weights of up to 1400 g/m$^2$ are also possible. This is the total weight of base structure and nonwoven layers, if present.

It is very advantageous for the invention if the proportion by weight of the nonwoven layers corresponds at most to the proportion by weight of the base structure, in particular at most ⅔ of the proportion by weight of the base structure.

Usually, in felts for tissue production, the proportion by weight of the nonwoven fibers is greater than that of the base structure. Normally, 60% of the total weight is nonwoven fibers and 40% is base structure.

Since, in the fabrics proposed here, as a result of the combination of MD fiber density and MD fiber diameter, part of the functionality of the nonwoven layer is performed by the base structure, it is possible to reduce the quantity of nonwoven fibers. As a result, lighter and thinner felts are possible.

In preferred embodiments, the fabric can have a thickness of 3.5 mm and less, preferably between 2.5 mm and 3 mm! For this purpose, the thickness is determined under a pressure of 0.1 MPa.

The relative proportion of the nonwoven fibers on the overall fabric additionally decreases. Therefore, for example, it is possible to use felts in which the base structure and nonwoven layers each make up 50% of the proportion by weight. The base structure can even represent the greater proportion of the weight of the felt. If 60% of the total weight stems from the base structure and only 40% from the nonwoven fibers, then the proportion by weight of the nonwoven layers corresponds to only ⅔ of the proportion by weight of the base structure.

Over the service life of the fabric, the nonwoven layers are additionally highly compressed, as a result of which important fabric properties, such as the permeability, are reduced. As a result of a lower proportion of nonwoven fibers in the overall fabric, these losses resulting from compression of the nonwoven fibers are lower, and the properties of the fabric remain for longer in a tolerable range.

It may, however, also be advantageous if the paper side of the fabric has a certain quantity of nonwoven fibers. This quantity should not lie below 10% of the total weight of the fabric. It is also advantageous, at least for the upper side of the fabric touching the paper, to provide nonwoven fibers which have a fineness between 11 and 22 dtex.

The nonwoven fibers can be made of any suitable material, in particular from a polyamide but also from an elastomer such as, for example, thermoplastic polyurethane (TPU), melt fibers, bicomponent fibers or mixtures thereof.

With regard to the machine, the object is achieved by a machine for producing a tissue web which comprises a press device with at least one press nip. The machine has at least one fabric according to one aspect of the invention. This fabric runs through the at least one press nip together with the tissue web during the operation of the press device.

Tissue papers normally consist of pulp and are very lightweight papers. The mass per unit area is normally between 15 g/m$^2$ and 30 g/m$^2$. However, values of 10 g/m$^2$ or 5 g/m$^2$ are also likewise possible, as are papers with more than 30 g/m$^2$.

In advantageous embodiments, the machine comprises what is known as a Crescent Former. Following the initial dewatering in the former, the fibrous web can then normally be transported on a fabric such as a felt into a press device, where further dewatering is carried out in the press nip.

Preferably, the press device has an extended nip, in particular a shoe nip. As compared with a likewise possible roll nip, here the residence time of the web in the nip is longer. As a result, in particular lower press pressures can be used. This is important during the production of tissue papers, since, as a result, the bulk of the web is maintained, which is an important quality parameter in tissue papers.

Furthermore, it may be advantageous if the press device has a wastewater trap which is set up to collect water which has been removed from the tissue web in the at least one press nip. As a result of using a felt according to one aspect of the invention—in particular in the extended nip or shoe presses—the dewatering performance of the press can also be increased by the fact that, in addition to the usual Uhle box dewatering, nip dewatering also takes place. Water (or a water-air mixture) from the tissue web is not only pressed into the fabric but also through the fabric. While the remaining part of the water pressed out is transported onward with the fabric to a Uhle box normally placed downstream, after the press nip this water enters the surroundings as splash water or spray mist. In addition, an escape of splash water forward counter to the running direction of the web is possible. This proportion of the dewatering is designated as nip dewatering. In order to prevent soiling of the press or uncontrolled wetting of the surroundings, it is advantageous to provide one or more wastewater traps in the press device. These are arranged such that the splash water can be collected and transported away.

By means of the fabric according to one aspect of the invention, and if necessary following the installation of a water trap, the dewatering performance of the press device can be increased considerably with very little outlay, even in existing tissue machines.

With regard to the method, the object is achieved by a method for producing a tissue web using a machine according to one aspect of the invention.

Advantageously, provision can be made for some of the dewatering to be carried out in the press device in the form of nip dewatering, and for this water thus removed to be wholly or partly collected by a wastewater trap.

In particular, provision can be made for the nip dewatering to make up more than 10%, in particular make up between 20% and 50%, of the total dewatering quantity of the press device.

In particular, it is advantageous if the tissue machine is operated at a high speed of more than 1200 m/min, in particular more than 1500 m/min or 1800 m/min. It is precisely at high production speeds that too low a dryness after the press is the limiting factor for an increase in the production speed. By means of the methods proposed here, the dryness after the press can be increased, which means that high production speeds are stably possible.

The invention will be explained in more detail below with reference to schematic figures, not to scale.

BRIEF DESCRIPTION OF THE FIGURE

The FIGURE shows a tissue machine according to one aspect of the invention.

DETAILED DESCRIPTION OF THE INVENTION

The FIGURE shows a tissue machine 1 according to one aspect of the invention. Using the example of this typical design of a tissue machine 1, exemplary aspects of the idea described here are to be explained. The invention is not restricted to this embodiment. A fibrous material suspension is applied via a headbox to a fabric 2 or between a fabric 2 and an outer wire 22. In a former 20, initial dewatering takes placed with the aid of an evacuated forming roll 21, around which the fabric 2 partly wraps. The former 20 in the FIGURE is designed as a Crescent Former, but other former types are also possible. The fibrous material web that has been produced is then transported into the press device 30, supported by the fabric 2. In the FIGURE, the press device 30 is designed as a shoe press 30. The press nip 31 is between the shoe roll 34 and a Yankee cylinder 41. The fabric 2 passes through the press nip 31 together with the tissue web 3. After the press nip, the web 3 runs onward on the upper surface of the Yankee cylinder 41. Here, a dryer hood 42 is arranged on the Yankee cylinder 41. By means of a creping doctor 43, the web 3 is detached from the Yankee cylinder 41 and transported onward to a reel-up 60. As shown in the FIGURE, a scanner 50 or another suitable measuring device 50, with which important parameters of the fibrous web 3 such as, for example, the thickness, moisture or mass per unit area are detected, can also be provided before the reel-up 60. If the scanner 50 is designed to be traversing, transverse profiles of these parameters can also be determined.

The fabric 2 of the machine 1 shown in the FIGURE is advantageously a fabric according to one aspect of the invention. Advantageously, it can comprise a base structure made of a flatweave, in particular a plain weave, which is made endless by connecting—e.g. welding—the front ends. The MD threads of this base structure in the embodiment all have a diameter between 0.25 mm and 0.45 mm, in particular between 0.3 mm and 0.35 mm. The thread density of the MD threads is more than 37%, preferably between 37% and 45%, particularly preferably between 39% and 43%. With a preferred weight of the fabric 2 between 750 g/m$^2$ and 1250 g/m$^2$, in particular between 900 g/m$^2$ and 1100 g/m$^2$, the nonwoven overlay can be reduced such that it makes up only half or less of the weight of the fabric. Since, in a fabric 2 according to one aspect of the invention, the base structure performs part of the function of the nonwoven layers, this fabric can be designed to be very thin. As opposed to the tissue machines 1 known from the prior art, when such a fabric 2 is used in the press nip 31, in particular in a shoe press nip 31, nip dewatering can be achieved. Hereby, splash water or spray mist is produced, which normally occurs after the press nip 31, but can sometimes also occur before the nip 31. In order to prevent soiling of the press 30 or uncontrolled wetting of the surroundings, it is advantageous to provide one or more wastewater traps 33 in the press device 30. In the FIGURE, a wastewater trap 33 is arranged after the press nip 31. Alternatively or additionally, a wastewater trap 33 can also be provided before the press nip 31. The wastewater trap or traps 33 pick up the proportion of the water which has been removed from the web 3 by nip dewatering. The remaining part is stored in the fabric 2 and transported away from the press nip 31. In order to remove this water from the fabric 2, in the installation shown in the FIGURE, a suction box 32, what is known as a Uhle box, is provided between press nip 31 and the headbox 10. In a method according to one aspect of the invention, the proportion of nip dewatering is more than 10%, preferably between 20% and 50%, of the total dewatering of the press 30.

LIST OF DESIGNATIONS

1 Tissue machine
2 Fabric

3 Tissue web
10 Headbox
20 Former
21 Forming roll
22 Outer wire
30 Press device
31 Press nip
32 Suction box, "Uhle Box"
33 Wastewater trap
34 Shoe roll
40 Drying apparatus
41 Yankee cylinder
42 Hood
43 Creping doctor
50 Scanner
60 Reel-up

The invention claimed is:

1. A fabric for use in a machine for producing a tissue web, the fabric comprising:

a base structure being a woven textile structure with machine direction (MD) threads and cross-machine direction (CD) threads;

said MD threads wholly or predominantly having a diameter of between 0.25 mm and 0.45 mm and said MD threads having a thread density of more than 37%; and at least one layer of nonwoven fibers connected to said woven textile structure by needle-punching, with said base structure and said at least one layer of nonwoven fibers together forming a felt.

2. The fabric according to claim 1, wherein at least one of the following is true:

said MD threads have a diameter of between 0.3 mm and 0.35 mm; or said MD threads have a thread density of between 37% and 45%.

3. The fabric according to claim 1, wherein:

said base structure is composed of two endless woven layers or of two woven layers that have been made endless;

each of said two woven layers has said MD threads which, wholly or predominantly, have a diameter of between 0.25 mm and 0.45 mm; and each of said two woven layers has said MD threads with a thread density of more than 37%.

4. The fabric according to claim 1, wherein said textile structure is a flatweave, wherein warp threads of a loom provide said MD threads of the fabric and said flatweave is made endless by connecting front ends thereof.

5. The fabric according to claim 4, wherein the front ends are welded to form a welded connection.

6. The fabric according to claim 1, wherein at least some of said CD threads are twisted threads.

7. The fabric according to claim 6, wherein 50% or more of said CD threads are twisted threads.

8. The fabric according to claim 1, wherein the fabric has a thickness of 3.5 mm or less.

9. The fabric according to claim 8, wherein the fabric has a thickness of between 2.5 mm and 3 mm.

10. The fabric according to claim 1, wherein a weight of the fabric lies between 750 g/m$^2$ and 1250 g/m$^2$.

11. The fabric according to claim 10, wherein the weight of the fabric lies between 900 g/m$^2$ and 1100 g/m$^2$.

12. The fabric according to claim 1, wherein a proportion by weight of said nonwoven layers corresponds at most to a proportion by weight of said base structure.

13. The fabric according to claim 12, wherein the proportion by weight of said nonwoven layers is at most ⅔ of the proportion by weight of said base structure.

14. A machine for producing a tissue web, comprising;

a press device with at least one press nip; and at least one fabric according to claim 1 disposed to run through said at least one press nip during an operation of said press device.

15. The machine according to claim 14, wherein said at least one press nip is an extended nip.

16. The machine according to claim 14, wherein said press device has a wastewater trap configured to collect water which has been removed from the tissue web in said at least one press nip.

17. A method for producing a tissue web, the method comprising: providing a machine according to claim 14 and producing the tissue web in said machine.

18. The method according to claim 17, which comprises dewatering the tissue web in the press device by nip dewatering, and wholly or partly collecting water thus removed by a wastewater trap.

19. The method according to claim 18, wherein the nip dewatering makes up more than 10% of a total dewatering quantity of the press device.

20. The method according to claim 19, which comprises dewatering the tissue web in the at least one nip by between 20% and 50%.

* * * * *